US006089883A

United States Patent [19]

McHugh et al.

[11] Patent Number: 6,089,883

[45] Date of Patent: Jul. 18, 2000

[54] BOARD-TO-BOARD CONNECTOR ASSEMBLY

[75] Inventors: Robert G. McHugh, Evergreen, Colo.; Theodore Chen, Yung-Ho, Taiwan

[73] Assignee: Hon Hai Precision Ind. Co., Ltd., Taipei Hsien, Taiwan

[21] Appl. No.: 09/348,985

[22] Filed: Jul. 7, 1999

Related U.S. Application Data

[63] Continuation of application No. 08/777,553, Dec. 30, 1996, abandoned.

[51] Int. Cl.[7] ..... H01R 4/66

[52] U.S. Cl. ..... 439/108; 439/79

[58] Field of Search ..... 439/74, 101, 108, 439/284, 290, 291, 295, 608, 947

[56] References Cited

U.S. PATENT DOCUMENTS

| | | | |
|---|---|---|---|
| 5,127,839 | 7/1992 | Korsumsky et al. | 439/79 |
| 5,169,324 | 12/1992 | Lemke et al. | 439/637 |
| 5,181,855 | 1/1993 | Mosquera et al. | 439/74 |
| 5,413,491 | 5/1995 | Noschese | 439/108 |
| 5,536,179 | 7/1996 | Olson et al. | 439/108 |
| 5,542,851 | 8/1996 | Chikano | 439/108 |
| 5,618,191 | 4/1997 | Chikano et al. | 439/108 |
| 5,645,436 | 7/1997 | Shimizu et al. | 439/108 |

*Primary Examiner*—Brian Sircus
*Assistant Examiner*—J. F. Duverne
*Attorney, Agent, or Firm*—Wei Te Chung

[57] ABSTRACT

An electrical connector assembly (10) comprises of a pair of plug and receptacle board-to-board connectors (12, 14). Each connector (12, 14) has an insulative housing (50, 16) with a plurality of contacts (54, 24) wherein each contact (54, 24) has substantially a cantilever type spring arm with a maximum deflection apex (B, A) thereof. Mated plug and receptacle connectors (12, 14) pass the maximum deflection apexes (B, A) of the contacts with each other to provide positive locking thereof. Each connector (12, 14) further includes a grounding plate (64, 32) longitudinally extending along the housing (50, 16) wherein coupling means (66, 35) are formed respectively on the grounding plate (64, 32) of each connector (12, 14) for combining such pair of grounding plates (64, 32) together. A pair of mounting devices (76, 38) are disposed adjacent two opposite ends of the housing (50, 16) of each connector (12, 14) and mechanically and electrically engaged with the respective distal ends of the corresponding grounding plate (64, 32) in the same connector (12, 14).

16 Claims, 10 Drawing Sheets

BOARD-TO-BOARD CONNECTOR ASSEMBLY

This is a continuation of application Ser. No. 08/777,553 filed Dec. 30, 1996 now abandoned.

BACKGROUND OF THE INVENTION

1. Field of the Invention

The invention relates to connector assemblies, and particularly to a pair of board-to-board receptacle and plug connectors each having a grounding plate extending thereof in a lengthwise direction wherein grounding, plates of such pair of connectors are mutually engaged with each other for establishment of an overall grounding effect of the whole connector assembly.

2. The Related Art

Board-to-board connector assemblies were popularly used in the recent years. For compliance with the internal space of a notebook computer, the tinier low profile connector assemblies are desired by the computer industry. The board-to-board connector assemblies can be referred to U.S. Pat. Nos. 5,310,357, 5,395,250, 5,545,051 and 5,547,385. Moreover, because of high frequency transmission being required in the computer and between the computer and its peripherals, grounding devices are generally required to reduce or filter noise or EMI (electromagnetic interference) during the high speed transmission. The connector with a plate-like built-in grounding means can be referred to U.S. Pat. Nos. 5,241,135, 5,263,870, 5,399,106 and 5,431,584.

Therefore, an object of the invention is to provide an electrical connector assembly composed of a pair of plug and receptacle connectors which not only interconnect two parallel boards, but also is adapted to be used in a high speed transmission system.

SUMMARY OF THE INVENTION

According to an aspect of the invention, an electrical connector assembly comprises of a pair of plug and receptacle board-to-board connectors. Each connector has an insulative housing with a plurality of contacts wherein each contact has substantially a cantilever type spring arm with a maximum deflection apex thereof. Mated plug and receptacle connectors pass the maximum deflection apexes of the contacts with each other to provide positive locking thereof. Each connector further includes a grounding plate longitudinally extending along the housing wherein coupling means are formed respectively on the grounding plate of each connector for combining such pair of grounding plates together. A pair of mounting devices are disposed adjacent two opposite ends of the housing of each connector and mechanically and electrically engaged with the respective distal ends of the corresponding grounding plate in the same connector.

DETAILED DESCRIPTION OF THE PREFERRED EMBODIMENTS

Figure 1:
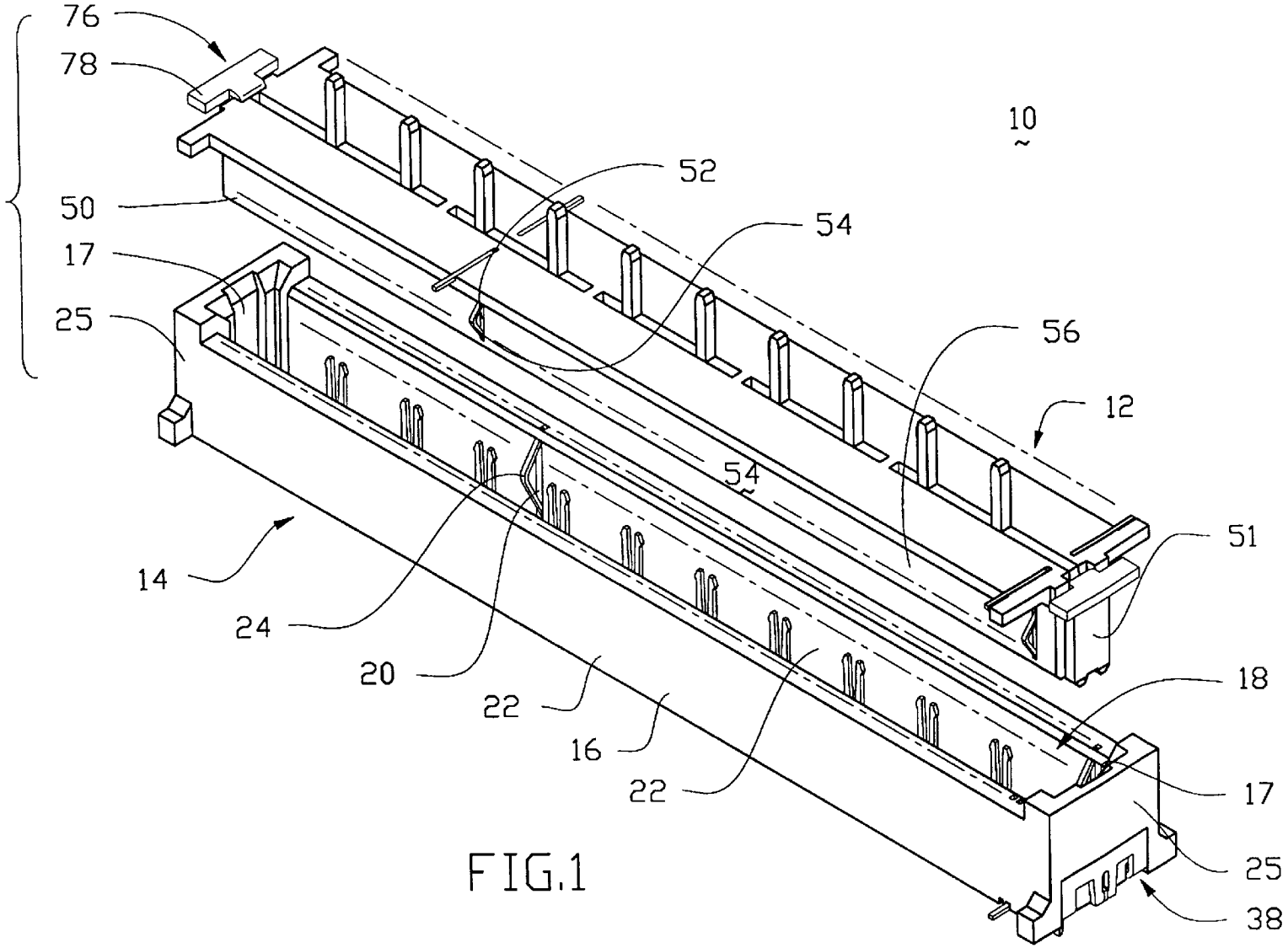
FIG. 1 is an exploded perspective view of a presently preferred embodiment of an electrical connector assembly consisting of a plug connector and a receptacle connector, according to the invention.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–4 wherein an electrical connector assembly 10 includes a plug board-to-board connector 12 and a receptacle board-to-board connector 14.

The receptacle connector 14 includes an elongated insulative housing 16 including a base 28, two side walls 22 and two end walls 25 for defining a cavity 18 therein. Two rows of passageways 20 are disposed along two opposite side walls 22 for receiving therein a corresponding number of first contacts 24 wherein each contact 24 projects into the cavity 18. An lengthwise slot 26 extends along an underside of a base 28 longitudinally of the housing 12 with a plurality of openings (not shown) upwardly extending toward and communicative with the cavity 18 for receiving a first grounding plate 32 therein.

The first grounding plate 32 includes a long strip type main body 34 adapted to be embedded within the slot 26 in the base 28 of the housing 16. Several fork type coupling devices 35 are arranged in generally equal intervals along the main body 35 for extending through the corresponding opening (not shown) in the base 28 and into the cavity 18. Corresponding to each coupling device 35, a mounting post 36 extends downwardly opposite to the coupling device 35 for soldering through the corresponding holes in and directly grounding on the PC board 100 (FIG. 5(C)).

A pair of first mounting brackets 38 are disposed in the corresponding pair of recesses 40 adjacent two opposite ends of the housing 16 in an interferential fit by the barbs 42 wherein a flexible engagement section 44 extends downward for retainably sandwiching the corresponding tip 46 of the main body 34 therein so that the grounding plate 32 can be retained in the housing 16 by the engagement with the mounting bracket 38. The mounting bracket 38 includes a pair of mounting planes 48 positioned by two sides of the engagement section 44, for surface mounting to the corresponding grounding circuit pads (not shown) on the PC board 100.

The plug connector 12 includes an insulative housing 50 defining a plurality of passages 52 for receiving a corresponding number of second contacts 54 therein. Each contact 54 projects out of the side surface 54 of the central raised island 56 so that when the plug connector 12 and the receptacle connector are mated and the central raised island 56 of the plug connector 12 is received within the cavity 18 of the receptacle connector 14, the contacts 54 of the plug connector 12 can be engaged with the corresponding contact 24 of the receptacle connector 14 (FIG. 5(C)).

Figure 2:
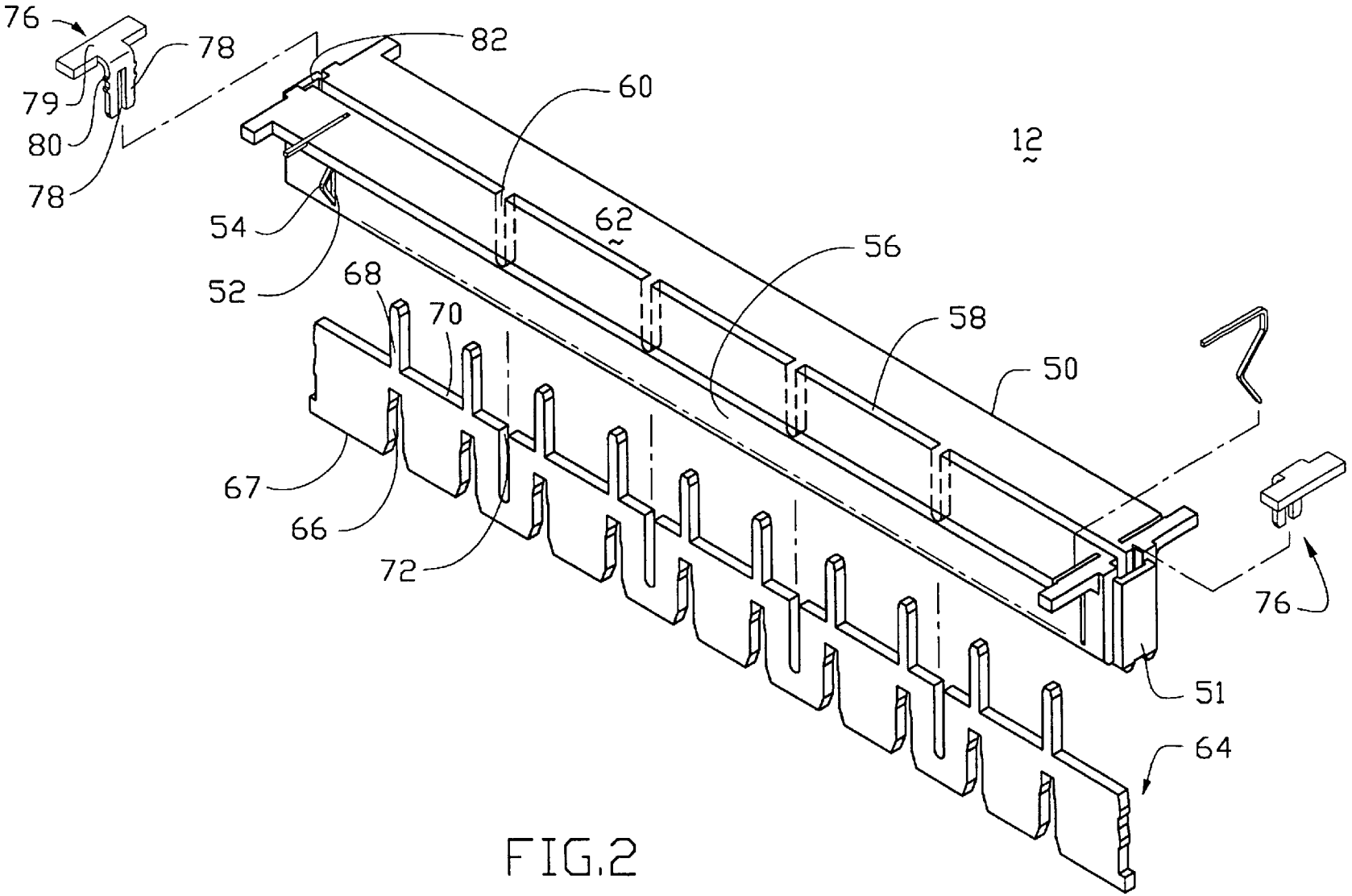
FIG. 2 is an exploded perspective view of the plug connector of FIG. 1.
Figure 3:
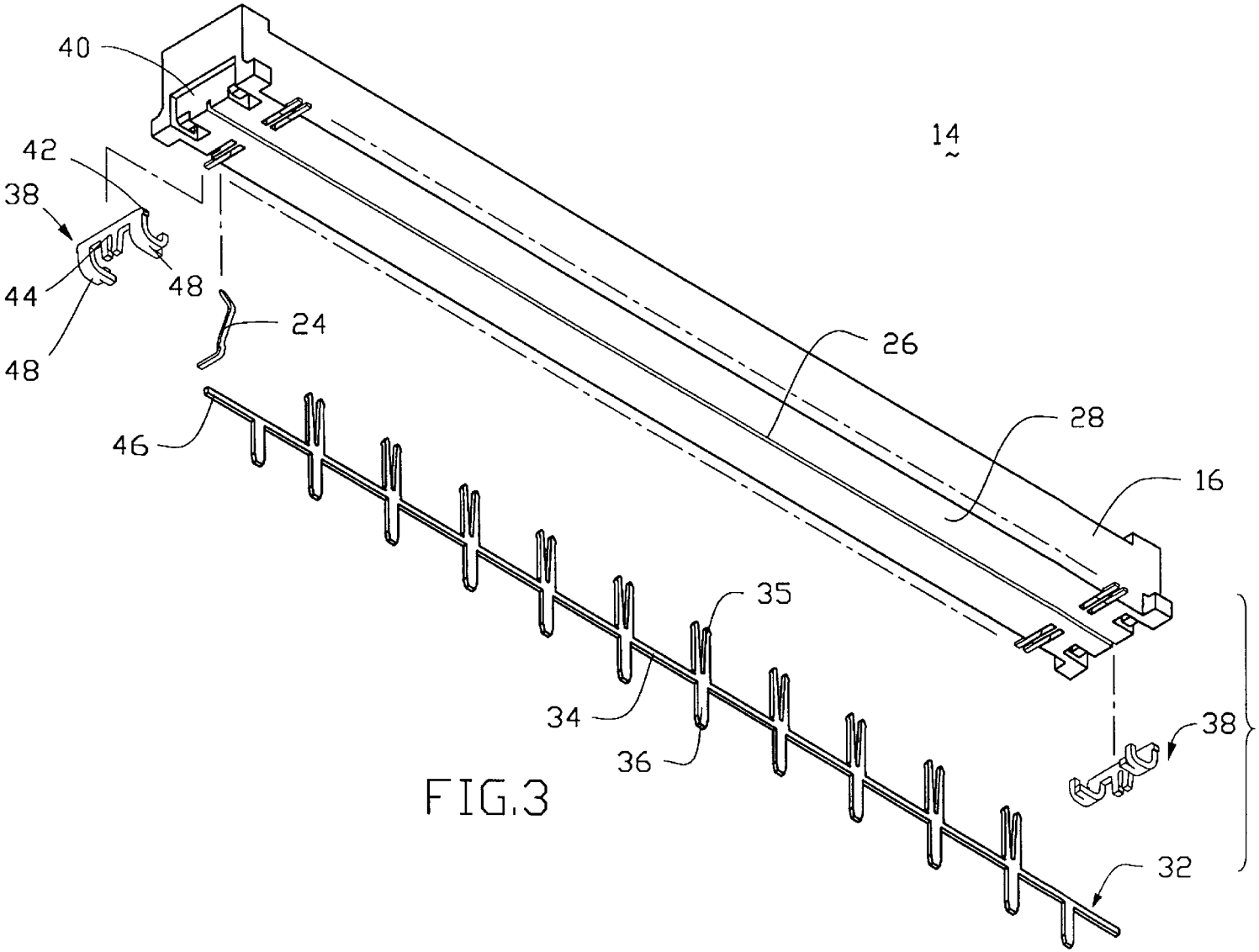
FIG. 3 is an exploded perspective view of the receptacle connector of FIG. 1.
Figure 4:
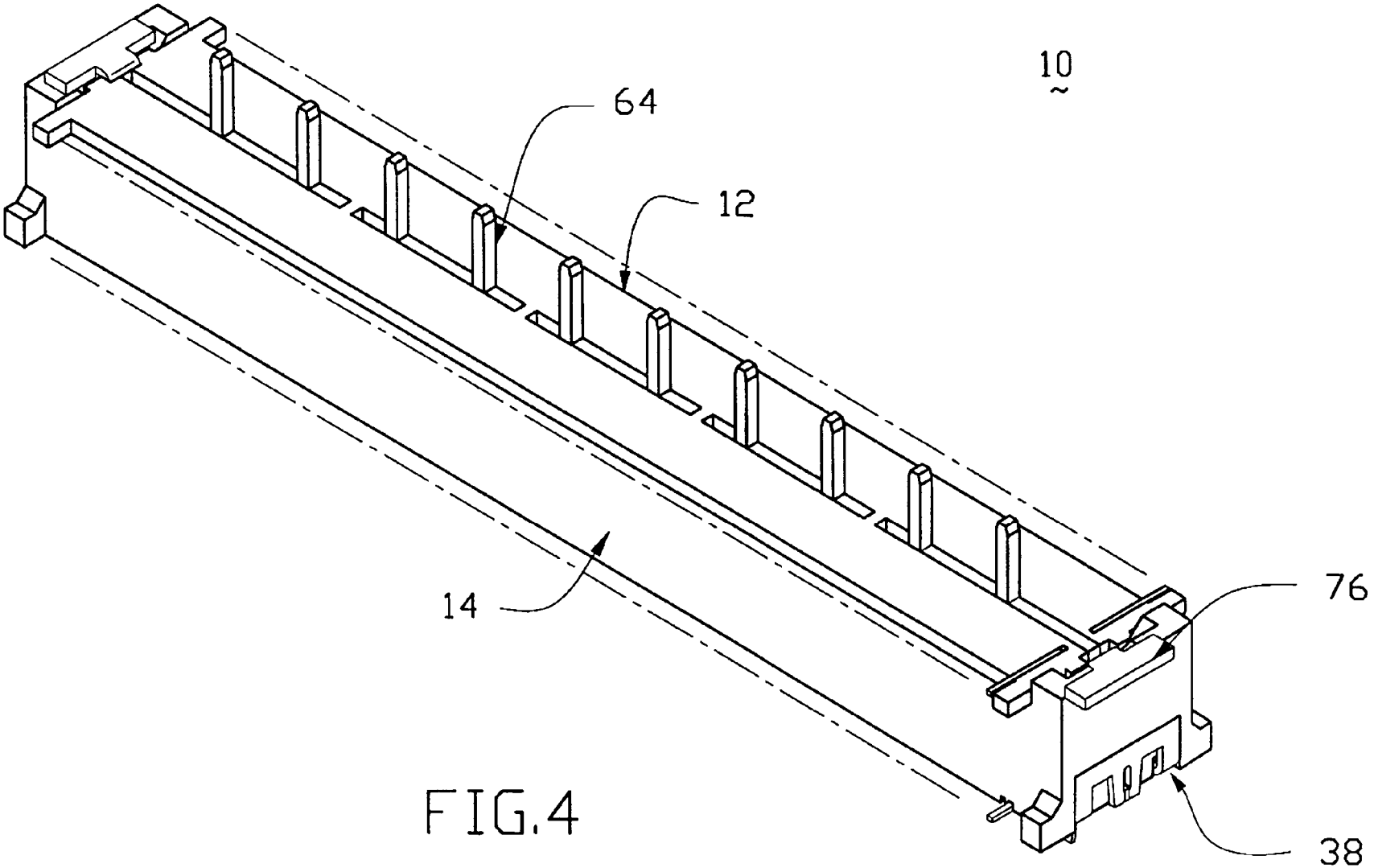
FIG. 4 is a perspective view of the assembled connector assembly of FIG. 1 including the plug connector and the receptacle connectors
Figure 5:
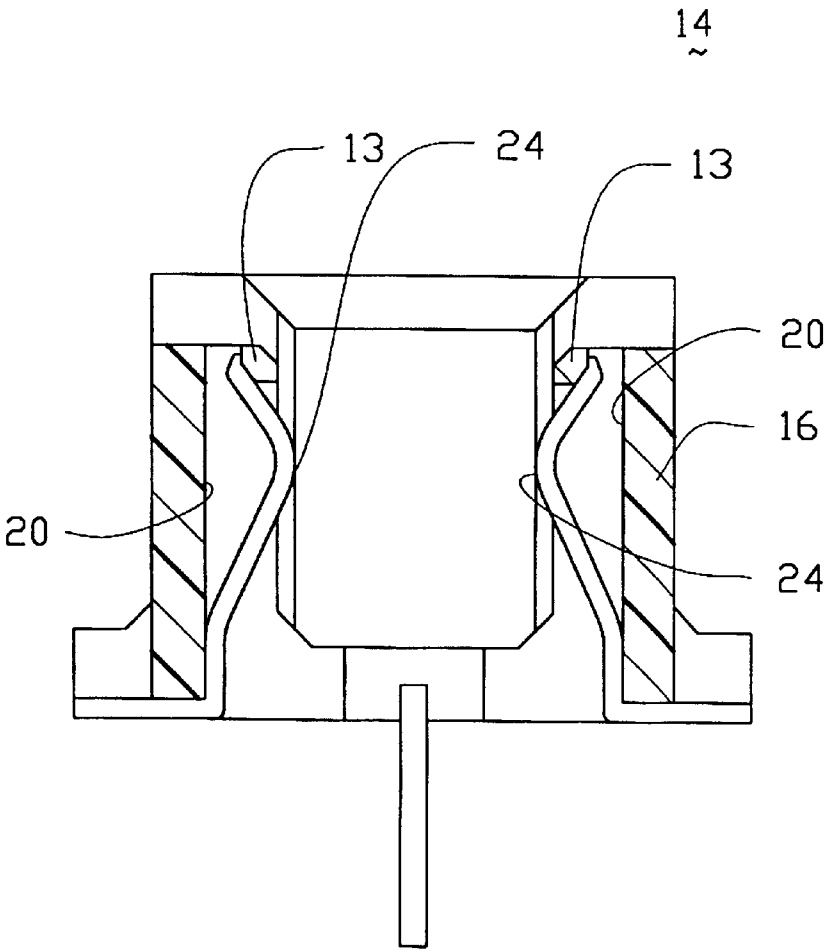
FIG. 5(A) is a cross-sectional view of the plug connector of FIG. 1.
FIG. 5(B) is a cross-sectional view of the receptacle connector of FIG. 1.
FIG. 5(C) is a cross-sectional view of the assembled connector assembly of FIG. 4.
Figure 5:
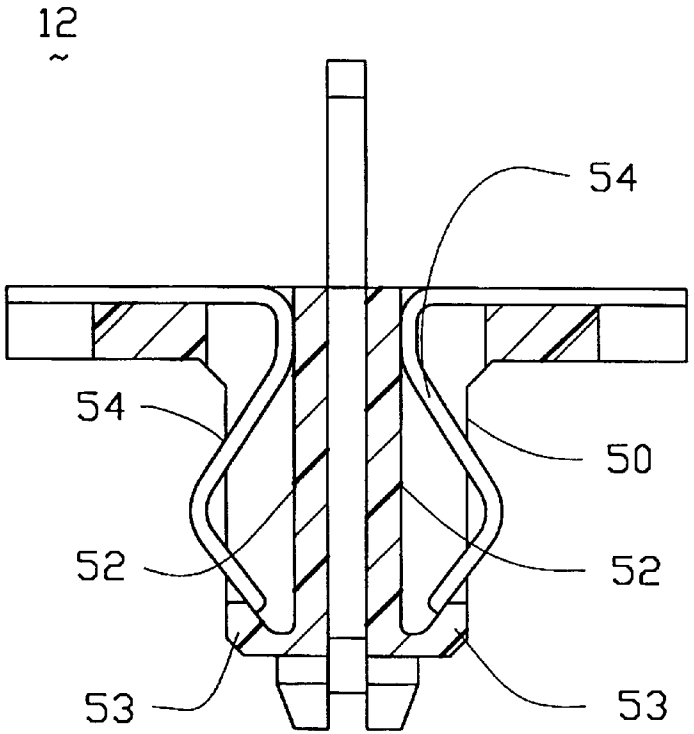
Figure 5:
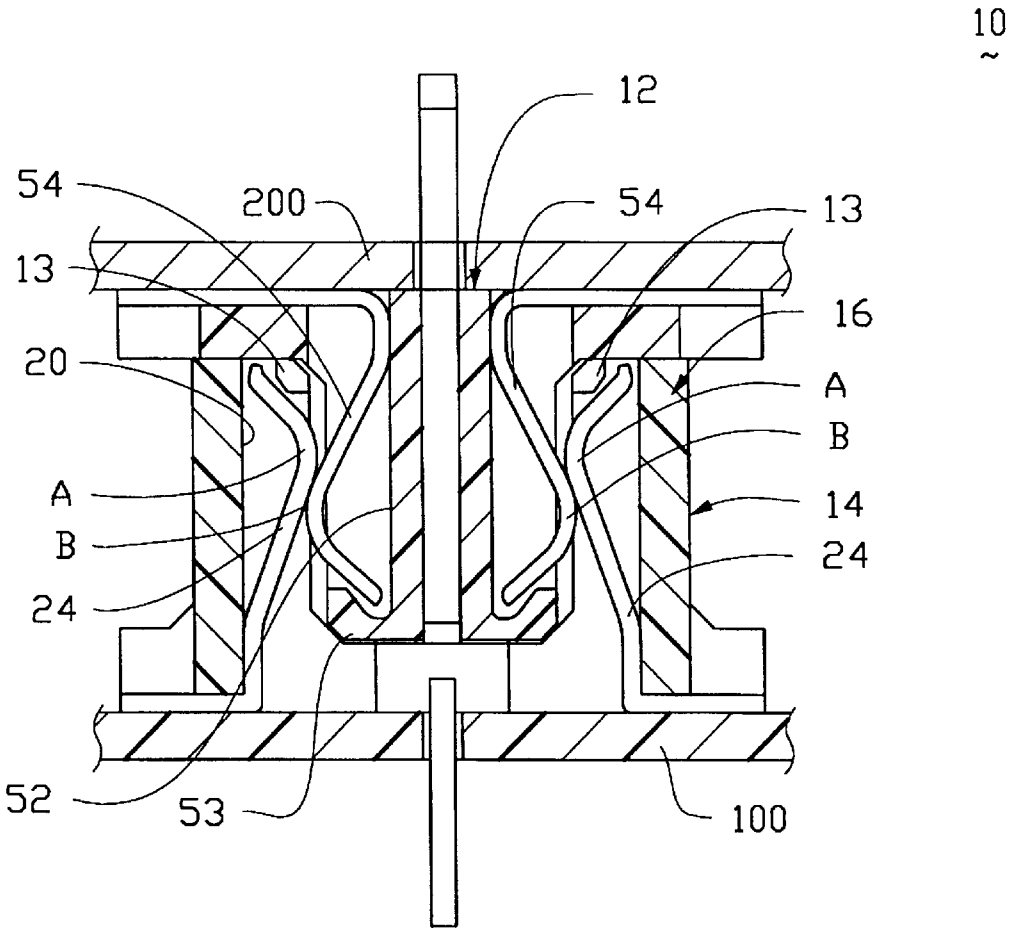
Figure 6:
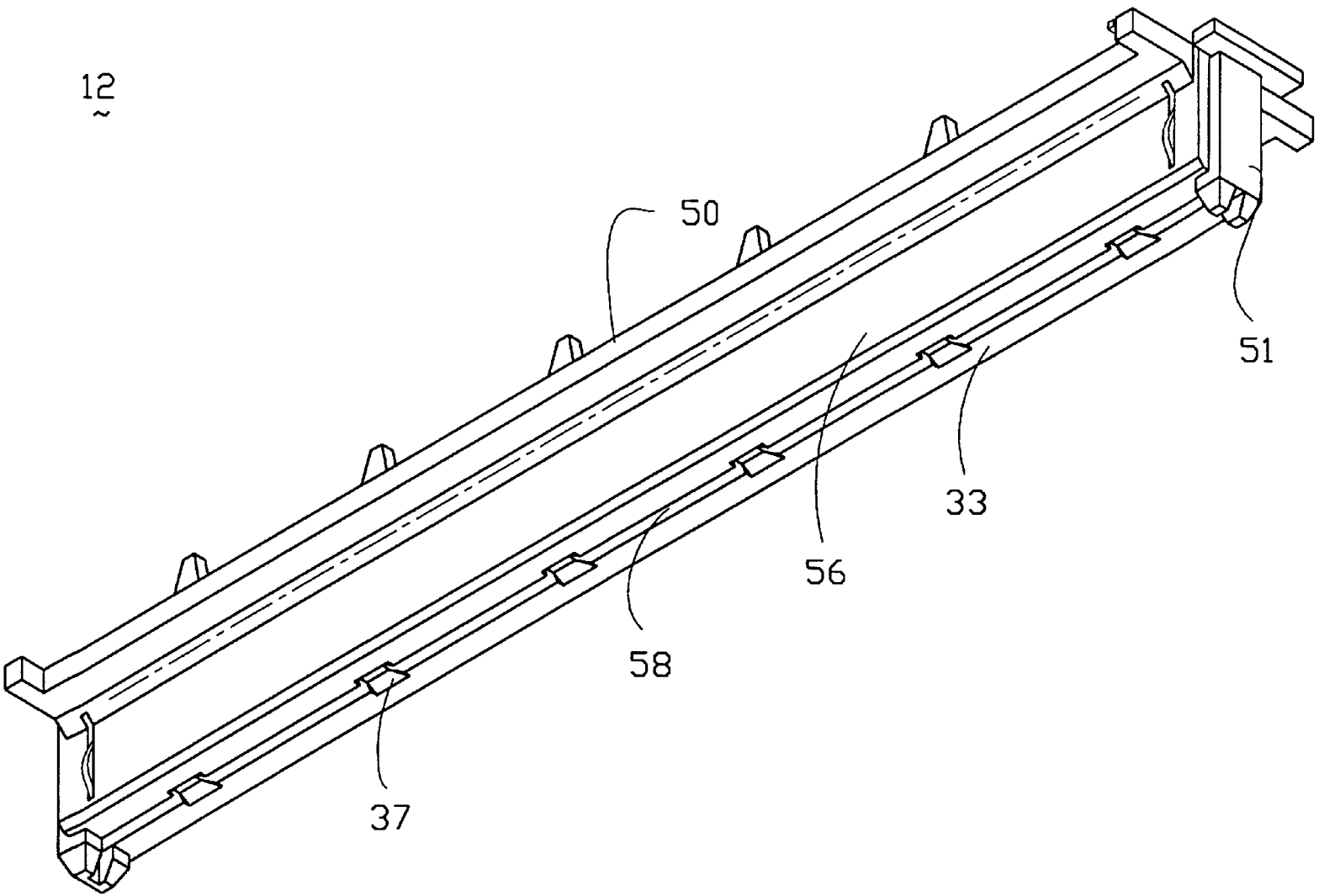
FIG. 6, is a bottom perspective view of the plug connector of FIG. 1 to show the underside thereof.

Referring to FIGS. 2 and 6, a slot 58 is formed lengthwisely along the central raised island 56 and extends through the central raised island 56 in the vertical direction except that several spaced seating keys 60 are positioned adjacent the bottom surface 62. Correspondingly, a second grounding plate 64 is received within the slot 58 in the housing 50 wherein a plurality of first notches 66 extending downward from the top edge 67, are arranged in equal intervals corresponding to the fork-type coupling devices 35 of the receptacle connector 14. Opposite to each notch 66, a post 68 extends downward from the bottom edge 70 of the grounding plate 64 for connecting to the grounding circuits on the PC board 200 (FIG. 5(C)) on which the plug connector 12 is mounted.

A plurality of second notches 72 are formed in a different pitch arrangement with regard to the first notches 66 in the grounding plate 64. Each notch 72 extends upward from the bottom edge 70 for compliance with the key 60 formed in the slot 58, so that the grounding plate 64 can be stably embedded in the slot 58 by means that the keys 60 are supportably engaged within the notches 66, respectively.

A pair of second mounting brackets 76 are disposed adjacent two opposite ends of the housing 50 wherein each mounting bracket 76 has a pair of flexible spaced arms 78 for capturing one end of the grounding plate 64 therebetween. Barbs 80 are formed on two sides of the arms 78 for interferential engagement within an aperture 82 in the housing 50. Therefore, the bracket 76 can be retainably attached to the housing 50 and the grounding plate 64 can be fixedly retained within the housing 50 by means of engagement with the bracket 76. The mounting bracket 76 further includes a mounting plane 79 for surface mounting to a corresponding grounding circuit pad (not shown) on the PC board 200.

Referring to FIGS. 1, 2 and 6, to easy coupling of these two connectors 12 and 14 to each other, the housing 50 of the plug connector 12 includes a pair of raised sections 51 adjacent two opposite ends and the housing 16 of the receptacle connector 14 includes a pair of recessions 17 in the base 28 whereby when these two connectors 12 and 14 are mated with each other, the raised sections 51 can offer an lead-in function and be finally received within the corresponding respective recessions 17 for performing an alignment effect between these two connectors 12, 14.

It is seen that to ease insertion of the fork-type coupling device 35 into the corresponding notch 66, a pair of chamfers 37 are formed on the top surface 33 of the housing 50 of the plug connector 12 adjacent to the corresponding notch 66 so that the coupling device 35 of the grounding plate 32 of the receptacle connector 14 may be guidably moved into the corresponding notch 66 of the grounding plate 64 of the plug connector 12.

When the plug connector 12 and the receptacle connector 14 are mated with each other, the central raised island 56 of the plug connector 12 may be substantially received within the cavity 18 of the receptacle connector 14, and the fork-type coupling devices 35 of the grounding plate 32 of the receptacle connector 14 may be connectively, mechanically and electrically, engaged within the corresponding notches 66 of the grounding plate 64 of the plug connector 12.

Referring to FIGS. 5(A) and 5(B), before mated with each other, the contacts 24 of the receptacle connector 14 and the contacts 54 of the plug connector 12 can be respectively engaged with the abutting blocks 13 in the passageways 20 of the housing 16 of the receptacle connector 14 and the abutting blocks 53 in the passages 52 of the housing 50 of plug connector 12 so that pre-loaded functions have been performed for both plug connector 12 and receptacle connector 14. Referring to FIG. 5(C), after mated with each other, the maximum deflection point A of the contact 24 and the maximum deflection point B of the contact 54 mutually pass over each other, whereby a mutually locking is implemented between these pair of mating contacts 24 and 54. Therefore, a plug connector 12 and the receptacle connector 14 an be efficiently retained with each other.

As known, most prior art connectors use a deflectable contact and a stiff contact to implement the engagement therebetween, while the invention uses two resilient contacts coupled to each other whereby both of mated contacts are preloaded, respectively, in their own housings before mating and mutually latchably engaged with each other in the whole assembly 10 after mating.

It can be known that the grounding plate 64 not only integrally connects the respective posts 68 as well as the grounding plate 32 does to its respective posts 36, but also intercepts the cross-talk between two rows of the contacts 52 by two sides of the slot 58.

Figure 7:
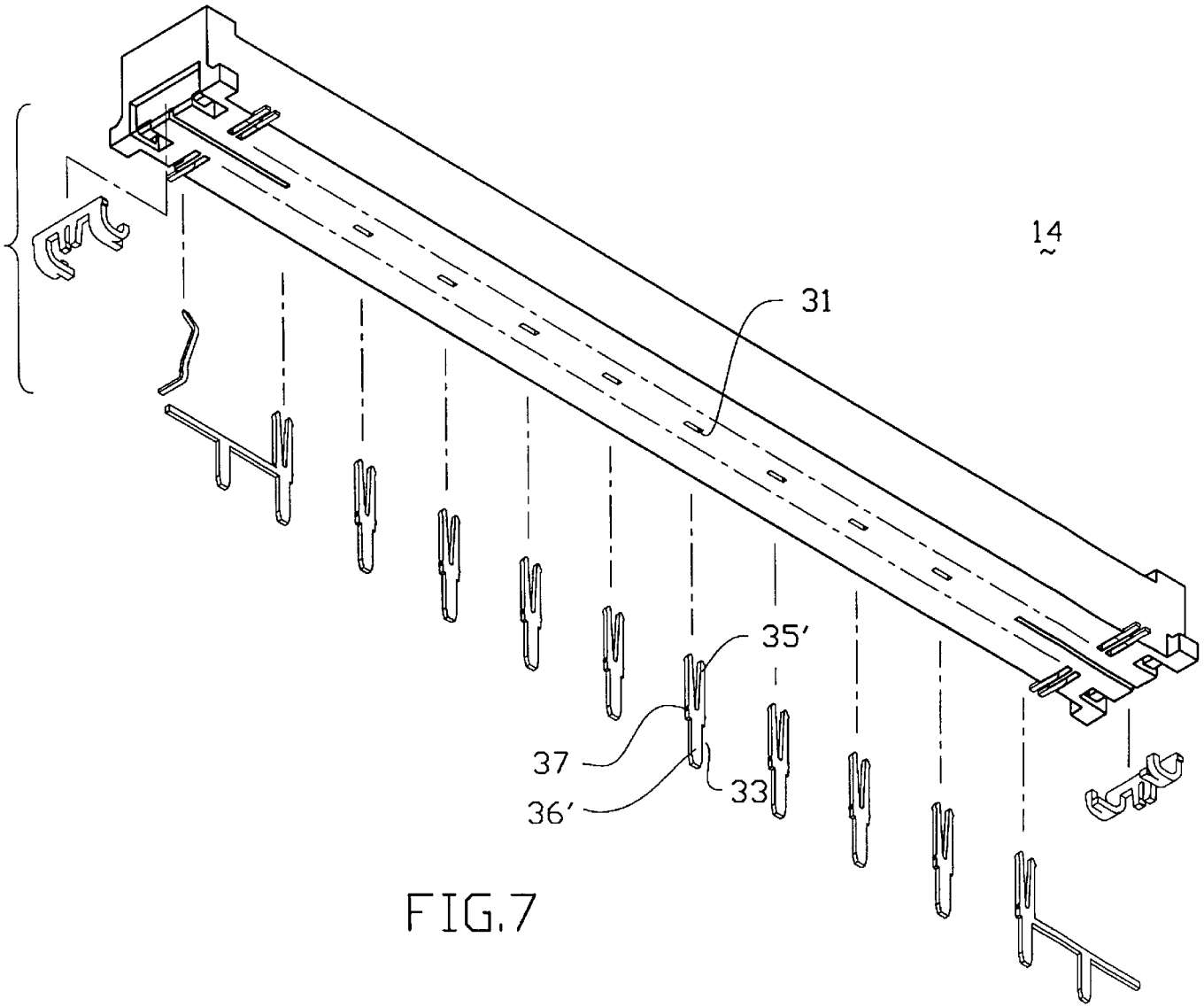
FIG. 7 is an exploded perspective view of another embodiment of a receptacle connector according to the invention.

FIG. 7 shows another embodiment of the receptacle connector 14 wherein the grounding plate 32 of the first embodiment is replaced by several small grounding pins 33 extending through the corresponding holes 31 and each having barbs 37 on two sides thereof, and coupling device 35' and a post 36' extending opposite to each other in the vertical direction.

Figure 8:
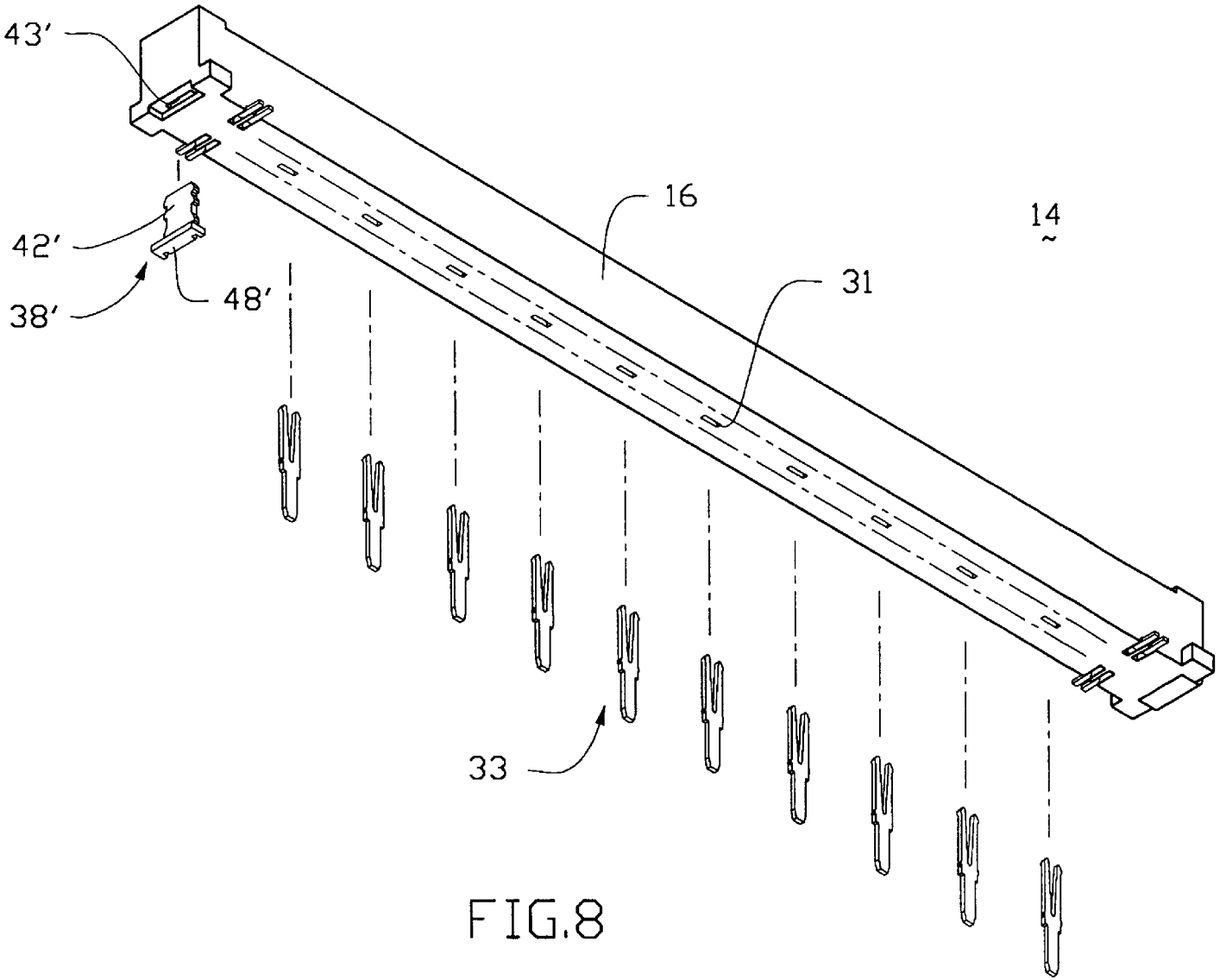
FIG. 8 is an exploded perspective view of a third embodiment of a receptacle connector according to the invention.

FIG. 8 shows a third embodiment of the receptacle connector 14 wherein the first mounting bracket 38' includes a vertical retention section 42' adapted to be received within a recess 43' in the housing 16 of the receptacle connector 14, and a horizontal outward extending soldering section 48' which is different from the inward extending mounting plane 48 of the first and the second embodiments. Additionally, referring to FIG. 9, the second grounding plate 64 further includes a spring tang 65 outward extending from the distal end thereof so that the feature of the third embodiment, is that in comparison with the previous other two embodiments, when the receptacle connector 14 and the plug connector 12 are mated with each other, a shorter grounding path is established from a grounding circuit pad on the PC board 200 on which the plug connector 12 is seated, through the mounting plane 79 of the second mounting bracket 76 of the plug connector 12, the spaced arms 78 of the second mounting bracket 76, successively the adjacent spring tang 65, the engaged vertical retention section 42' of the first mounting bracket 38' and the outward extending horizontal mounting plane 48' of the first mounting bracket 38', finally to the grounding pad on the PC board 100 on which the receptacle connector is seated.

Figure 9:
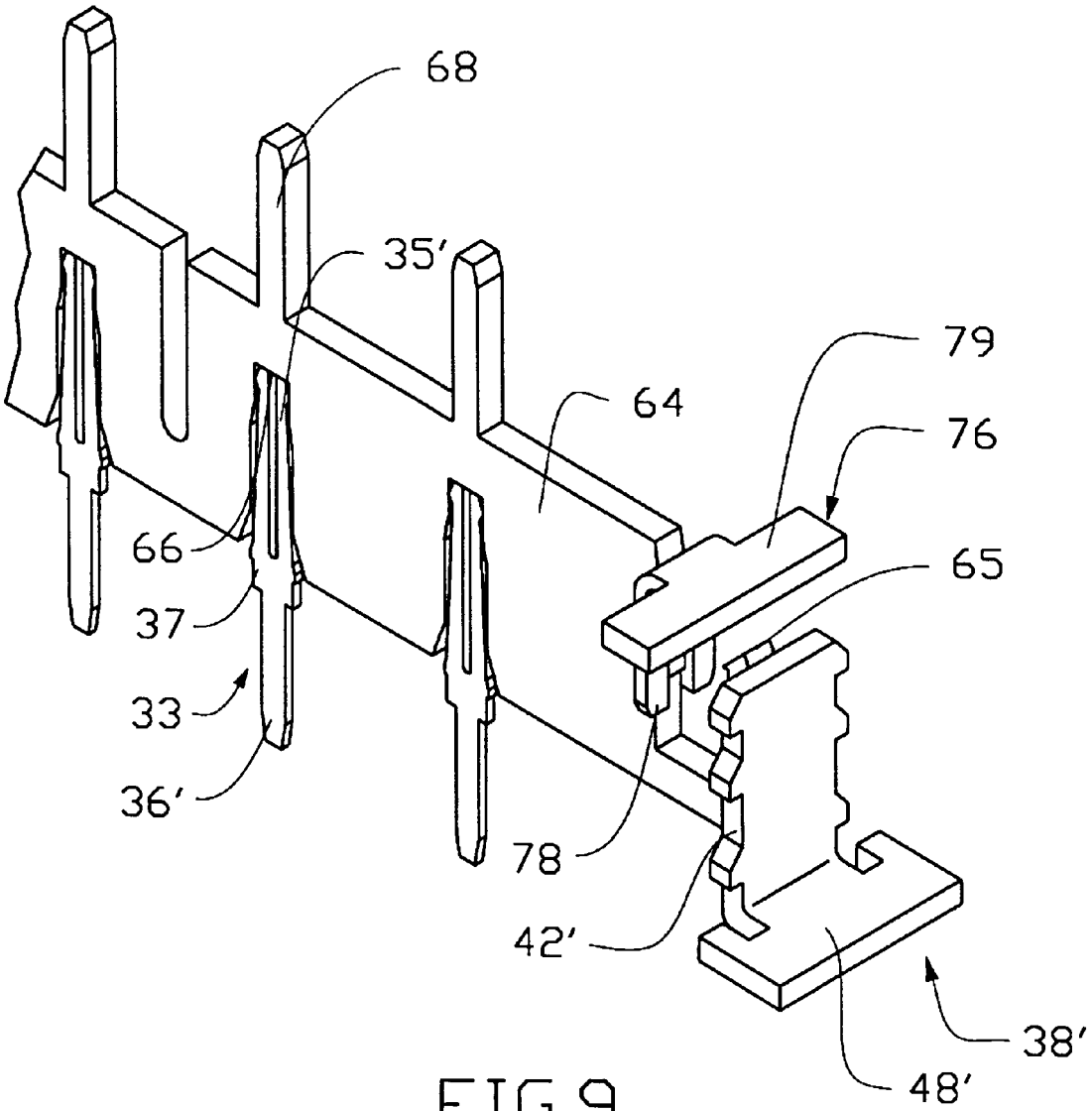
FIG. 9 is a fragmentary perspective view of a third embodiment of an assembly showing a plurality of grounding pins of the receptacle connector engaged with a second grounding plate of the plug connector wherein a spring tang of the second grounding plate of the plug connector substantially engages a vertical section of a first mounting bracket of the receptacle connector to form a shorter grounding path between the first mounting bracket of the receptacle and the second mounting bracket of the plug connector.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims. For example, in the third embodiment as shown in FIGS. 8 and 9, the grounding pin 33 of the receptacle connector 14 can be arranged to be orthogonal to the grounding plate 64 of the plug connector 12 in place of the original aligned arrangement, wherein the notches 66 of the grounding plate 64 can be removed therefrom and the fork-like coupling device 35' can straddle orthogonally on the grounding plate 64.

Therefore, person of ordinary skill in this field are to understand that all such equivalent structures are to be included within the scope of the following claims.

We claim:

1. An electrical connector assembly comprising a plug connector and a receptacle connector respectively mounted on a pair of parallelly spaced PC boards, said receptacle connector including an insulative elongate first housing defining a central cavity for receiving a central raised island of said plug connector therein, two rows of passageways defined in said first housing along sides of said cavity, each passageway receiving a corresponding first contact therein;

a first integrally-formed, strip-typed grounding plate assembled to said first housing and continuously extending along a full length of the first housing, said first grounding plate comprising a plurality of first coupling devices received in the cavity and a plurality of first grounding posts extending out of the first housing for being electrically connected to one of the PC boards;

the plug connector comprising an insulative elongate second housing;

a plurality of passages formed in the second housing for receiving a corresponding number of second contacts therein;

a second integrally-formed, strip-typed grounding plate received within a slot defined along a lengthwise direction along the second housing, said second grounding plate continuously extending along a full length of the second housing;

a plurality of second coupling devices each integrally formed along a long strip type main body of the second grounding plate for mechanical and conductive engagement with one corresponding first coupling device of the first grounding plate in the receptacle connector; and a plurality of second grounding posts each integrally formed along the long strip type main body opposite the second coupling devices for being electrically connected to the other PC board.

2. The assembly as recited in claim 1, wherein one of said first and second coupling devices is a fork type member, an the other is a notch for receiving said fork type member therein.

3. The assembly as recited in claim 1, wherein said first grounding posts on said first grounding plate and said second grounding posts on said second grounding plate extend respectively through the corresponding PC boards.

4. The assembly as recited in claim 1, wherein said second grounding plate further includes a plurality of notches for supportable engagement with a plurality of corresponding keys fromed on said second housing.

5. The assembly as defined in claim 1, wherein said first grounding plate is loaded into the first slot of the first housing of said receptacle connector from a bottom portion thereof, said second grounding plate is loaded into said second slot of said second housing of said plug connector from a top portion thereof.

6. A receptacle connector for cooperation with a plug connector both of which are respectively mounted on a pair of spaced parallel PC boards, said receptacle connector comprising:

an insulative elongated housing including a base, two side walls and two end walls commonly defining a cavity therein for receiving a central raised island of said plug connector therein;

two rows of passageways disposed in said two side walls, respectively, for receiving a corresponding number of contacts therein;

a central slot formed along a central line of said housing for receiving an integrally formed grounding plate therein, said grounding plate extending continuously along a full length of said housing; and a plurality of coupling devices integrally formed along a long strip main body of said grounding plate for direct engagement with another grounding plate in said plug connector.

7. The receptacle connector as defined in claim 6, wherein a plurality of openings are formed communicative with said slot for allowing said coupling devices to extend upward therethrough, and said slot extends upward from a bottom surface of said housing so that said grounding plate can be installed into said housing from a bottom direction.

8. A plug connector for cooperation with a receptacle connector both of which are mounted to a pair of parallelly spaced PC boards, respectively, said plug connector comprising:

a housing having a central raised island defining two rows of passages along side surfaces of the central raised island for receiving a corresponding number of contacts therein;

a slot defined lengthwise between two rows of contacts for securely receiving therein a unitary strip like grounding plate continuously extending along a full length of the housing; and a plurality of coupling devices integrally formed along the grounding plate for direct respective engagement with a corresponding number of grounding pins of the receptacle connector.

9. The plug connector as recited in claim 8, wherein said grounding plate includes a plurality of notches for reception of keys of said housing therein.

10. The plug connector as recited in claim 8, wherein said grounding plate is loaded into said slot from a top direction.

11. An electrical connector assembly comprising a plug connector and a receptacle connector respectively mounted on a pair of parallelly spaced PC boards, said receptacle connector including an insulative elongate first housing defining a central cavity for receiving a central raised island of said plug connector therein, two rows of passageways defined in said first housing along sides of said cavity, each passageway receiving a corresponding first contact therein;

a plurality of grounding pins individually and independently assembled to said first housing, each grounding pin including a first coupling device extending into said cavity;

the plug connector comprising an insulative elongate second housing;

a plurality of passages formed in the second housing for receiving a corresponding number of second contacts therein;

an integrally-formed, strip-typed grounding plate received within a slot defined along a lengthwise direction along the second housing, said grounding plate continuously extending along a full length of the second housing; and a plurality of second coupling devices each integrally formed along a long strip type main body of the grounding plate for mechanical and conductive engagement with one corresponding first coupling device in the receptacle connector.

12. The electrical connector assembly as recited in claim 11, wherein each of said grounding pins further includes a post extending downward.

13. An arrangement for intercepting cross-talk between two rows of contacts, comprising:

a first connector and a second connector respectively mounted on two spaced parallel PC boards where each of said first connector and second connector has two rows of contacts; and said first connector further including first grounding means cooperating with second grounding means of said second connector, said first grounding means and said second grounding means being arranged along a lengthwise direction of the respective connectors; wherein at least one of said first grounding means and second grounding means includes a strip main body on which a plurality of coupling devices are integrally formed, and said strip type main body continuously extends along a full length of the corresponding connector.

14. The arrangement as recited in claim 13, wherein the other of said first and second grounding means includes a plurality of grounding pins.

15. The arrangement as recited in claim 13, wherein the other of said first and second grounding means includes a second strip type main body with a plurality of second type coupling devices integrally formed thereon, said second strip type main body being received in the second connector and continuously extending along a full length thereof.

16. An electrical connector assembly of a plug connector and a receptacle connector respectively mounted on a pair of parallelly spaced PC boards;

said receptacle connector comprising an insulative elongated first housing for receiving an insulative elongated second housing of the plug connector therein;

a plurality of grounding pins individually independently arranged at intervals along the first housing, each grounding pin including a first coupling device;

a grounding plate adapted to be received within a slot in a lengthwise direction along the second housing, said grounding plate including a plurality of notches for respectively receivably aligned engagement with the first coupling devices of the grounding pins; and the first coupling devices of said plurality of grounding pins mechanically and electrically engaged with a long strip type main body of the grounding plate wherein said strip type main body continuously extends along a full length of the second housing.

* * * * *